US006283098B1

(12) United States Patent
Corkill

(10) Patent No.: US 6,283,098 B1
(45) Date of Patent: Sep. 4, 2001

(54) FUEL SYSTEM LEAK DETECTION

(75) Inventor: William John Corkill, Leics (GB)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/347,732

(22) Filed: Jul. 6, 1999

(51) Int. Cl.[7] ..... F02M 33/02
(52) U.S. Cl. ..... 123/520; 123/198 D
(58) Field of Search ..... 123/520, 518, 123/519, 198 D; 73/118.1

(56) References Cited

U.S. PATENT DOCUMENTS

| | | | | |
|---|---|---|---|---|
| 5,085,194 | * | 2/1992 | Kuroda et al. | 123/479 |
| 5,085,197 | * | 2/1992 | Mader et al. | 123/520 |
| 5,105,789 | * | 4/1992 | Aramaki et al. | 123/520 |
| 5,261,379 | * | 11/1993 | Lipinski et al. | 123/520 |
| 5,333,590 | | 8/1994 | Thomson | 123/520 |
| 5,396,873 | | 3/1995 | Yamanaka et al. . | |
| 5,450,834 | | 9/1995 | Yamanaka et al. . | |
| 5,483,942 | * | 1/1996 | Perry et al. | 123/520 |
| 5,490,414 | | 2/1996 | Durschmidt et al. | 73/49.2 |
| 5,542,397 | | 8/1996 | Takahata et al. | 123/520 |
| 5,614,665 | | 3/1997 | Curran et al. . | |
| 5,746,191 | | 5/1998 | Isobe et al. . | |
| 5,765,121 | | 6/1998 | Schwager et al. | 701/104 |

* cited by examiner

*Primary Examiner*—Henry C. Yuen
*Assistant Examiner*—Mahmoud Gimie
(74) *Attorney, Agent, or Firm*—James R. Drouillard

(57) ABSTRACT

A vehicle fuel system has on-board diagnostics for leak testing with correction for different operating conditions. An electronic control unit (ECU) is arranged to carry out a periodic two stage leak test, when the engine is running. Stage A includes evacuation of the fuel tank, monitoring bleedup and recording the pressure rise dP_A over a predetermined period A following increase of pressure to a predetermined value p2. Stage B includes measuring the amount dP_B by which the pressure in the tank rises above atmospheric due to vapor generation over a predetermined period B following venting and closure fuel system. The ECU calculates a value X representative of leakage from the difference between dP_A and dP_B using a scaling factor K dependent on measured values of operating conditions, which may include fuel level/fuel tank free volume and/or ambient temperature.

4 Claims, 2 Drawing Sheets

| Table of Values of K | | Fuel Level - % of Full Tank | | | | | |
|---|---|---|---|---|---|---|---|
| | | 95% | 80% | 60% | 45% | 30% | 10% |
| Ambient Temperature - T | -10°C | 1.00 | 1.10 | 1.20 | 1.30 | 1.40 | 1.50 |
| | 0°C | 0.95 | 1.05 | 1.15 | 1.25 | 1.35 | 1.45 |
| | 15°C | 0.90 | 1.00 | 1.10 | 1.20 | 1.30 | 1.40 |
| | 20°C | 0.86 | 0.96 | 1.06 | 1.16 | 1.26 | 1.36 |
| | 30°C | 0.82 | 0.92 | 1.02 | 1.12 | 1.22 | 1.32 |
| | 40°C | 0.80 | 0.90 | 1.00 | 1.10 | 1.20 | 1.30 |

FUEL SYSTEM LEAK DETECTION

FIELD OF THE INVENTION

This invention relates to a vehicle fuel system with on-board diagnostics for evaporative leak testing.

BACKGROUND OF THE INVENTION

Vehicle fuel systems are required to control emission of fuel vapor. This is done by collecting vapor emitted from the fuel tank in a purge canister containing carbon to absorb the vapor. The canister is purged of collected vapor when the engine is running by drawing air through the canister into the engine, relying on manifold vacuum. The system is sealed except for venting to the atmosphere via the purge canister. On-board evaporative leak testing is required to ensure that leakage from the sealed system does not exceed acceptable limits. Typical known leak testing systems are described U.S. Pat. Nos. 5,333,590 and 5,765,121.

The latter patent describes a basic test in which the manifold vacuum is used to pump out the fuel tank and the return of tank pressure to atmospheric ("bleedup") is monitored. If bleedup exceeds a certain threshold value R the system is determined to have an unacceptable leak. If the bleedup is less than R, it assumed that there is no such leak. Leaks of less that a certain size cannot be reliably detected with this basic system because vapor generation from fuel in the tank can cause pressure in the evacuated system to recover more rapidly than small leaks.

In addition, the bleedup for a particular leak size depends on vapor volume, that is the volume of free space above the fuel tank and in the purge canister and connecting passages. Vapor volume is itself directly related to fuel level.

Thus, in order to improve the sensitivity of the basic bleedup test, measures must be taken to correct for different operating conditions, particularly the fuel level and the rate of vapor generation in the tank.

For example, U.S. Pat. No. 5,333,590 uses a threshold value R which is not fixed but is related to vapor volume and fuel temperature.

It is also known to improve the sensitivity of leak testing by using a two stage test. The first stage is a bleedup test in which pressure increase over a certain period (period_A) is measured. A second stage is carried out in which pressure rise of the closed system from atmospheric over a second period (period_B) is monitored. The second stage gives an indication of vapor generation in the tank under prevailing conditions. A constant scaling factor is used to deduct a proportion of pressure rise found during the second stage to provide a value which more closely represents the level of bleedup due to leakage into the tank during the first stage of the test.

The present invention seeks to make further improvements to evaporative fuel system leak testing to enable smaller leaks to be reliably detected under varying ambient and operating conditions.

SUMMARY OF THE INVENTION

According to the present invention a vehicle fuel system with on-board diagnostics for leak testing comprises:

a) a fuel tank for containing fuel for delivery to an internal combustion engine;

b) a purge canister connected to the space in the tank above the fuel;

c) a canister vent valve (CVV) for connecting the purge canister to the atmosphere;

d) a purge valve for connecting the purge canister to the engine; and e) an electronic control unit (ECU) arranged for monitoring pressure and fuel level in the tank and other engine, vehicle and ambient conditions and for controlling opening and closing of the valves;

f) the CVV and the purge valve being controlled by the ECU for venting the tank to atmosphere via the purge canister (purge valve closed, CVV open), and for purging vapor from the canister by allowing air to be drawn through the canister by manifold vacuum (both valves open);

g) the ECU being arranged to carry out a periodic two stage leak test, when the engine is running;

h) one stage of the leak test comprising:

i) evacuation of the tank with the purge valve open and the CVV closed;

ii) monitoring pressure rise in the tank with both valves closed; and iii) recording the pressure rise dP_A over a predetermined period A following increase of pressure to a predetermined value p2;

i) the other stage of the leak test comprising:

i) venting the tank to atmospheric pressure via the CVW then sealing the tank by closing the CVW; and ii) measuring the amount dP_B by which the pressure in the tank rises above atmospheric due to vapour generation over a period (period_B) following closure of the CVV; and j) the ECU being arranged to calculate a value X representative of leakage from the difference between dP_A and dP_B using a scaling factor K dependent on measured values of operating conditions.

Preferably, values of K are stored in a 2-dimensional map giving a value of K for combinations of measured values of fuel level and ambient temperature. K may also be mapped against other relevant parameters. The leak test is sensitive to vapor volume in the system but it is more convenient to measure fuel level, which is simply and directly related to vapor volume since vehicles are equipped with means for sensing fuel level. The measured pressures are more directly related to fuel temperature than ambient temperature but it is more convenient to use ambient temperature, for which a sensor is usually available in most vehicles than to provide an additional temperature sensor dedicated to fuel temperature.

The improved fuel system test contemplated by the invention is preferably implemented using the vehicle's existing electronic engine control unit and the fuel system pressure sensor which is used for other purposes. As a consequence, the benefits of the invention may be obtained at very little additional cost.

These and other features and advantages of the present invention may be better understood by considering the following detailed description of a preferred embodiment of the invention.

During the course of this description, frequent reference will be made to the attached drawings.

DESCRIPTION OF THE PREFERRED EMBODIMENT

Figures 1, 2:
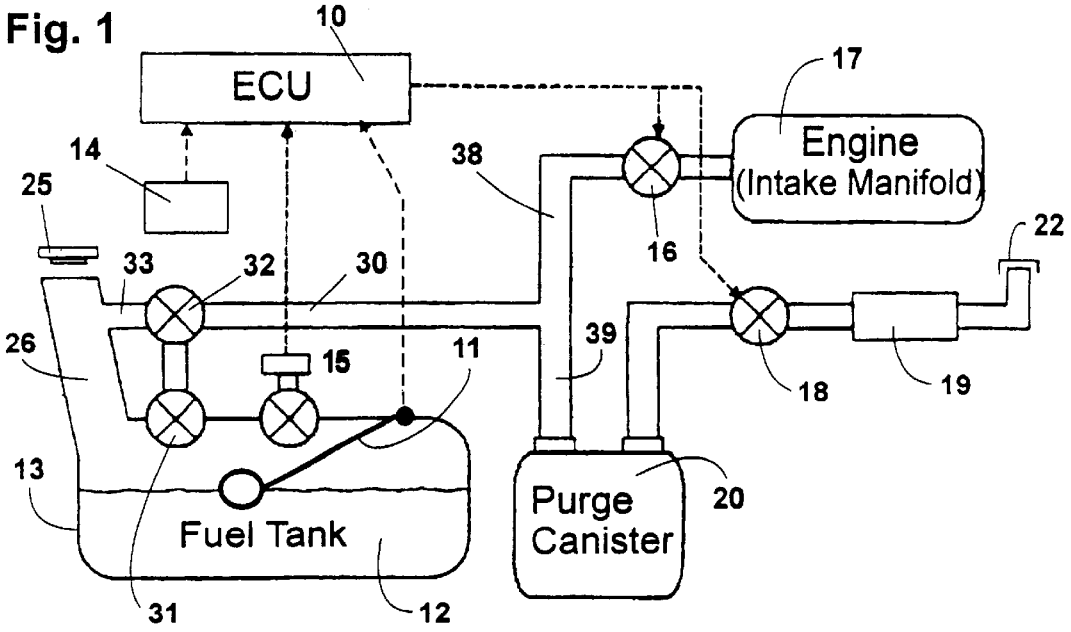
FIG. 1 is a schematic diagram of a vehicle fuel system with on-board diagnostics for leak testing which utilizes the principles of the invention.
FIG. 2 is a table showing information stored in the electronic control unit of the embodiment of FIG. 1.

A two stage diagnostic procedure for leak testing is performed automatically at predetermined intervals by an electronic control unit (ECU) 10 seen in FIG. 1. The test is aborted if prevailing conditions (fuel sloshing, heavy acceleration etc) are such that a reliable test result cannot be expected.

The ECU 10 is connected to a fuel level sender 11 for sensing the level of fuel 12 in a fuel tank 13, an ambient temperature transducer 14, and a fuel tank pressure transducer 15.

The ECU controls a vapor management valve (VMV) 16 and a normally open canister vent valve (CVw) 18. The CVV controls the air flow through a filtered passageway 19 which connects a purge canister 20 containing charcoal for absorbing fuel vapor to an atmospheric vent 22. The VMV 16, when open, connects the purge canister 20 to the intake manifold 17 of the vehicle engine via lines 38 and 39.

The closed fuel system seen in FIG. 1 further includes a vacuum/pressure relief valve within a cap 25 which closes the fuel inlet passageway 26 of the fuel tank 13. A passageway 30 extends from a rollover valve 31 at the top of the tank 13 to both the purge canister 20 and the VMV 16. A running-loss vapor control valve 32 connects the passageway 30 to the upper portion of the fuel inlet passageway 26 via a branch passageway 33.

When the vehicle engine in not running the ECU closes the VMV 16 and opens the CVV 18 so that fuel vapor is absorbed by carbon in the purge canister before reaching the atmosphere. Moreover, air may enter the fuel system via the purge canister 20 if pressure in the tank falls below atmospheric due to condensation of vapor. When the engine is running, the ECU from time to time opens both VMV 16 and CVV 18 so that air is drawn through the purge canister by manifold vacuum to purge fuel vapor from the canister.

Figure 3:
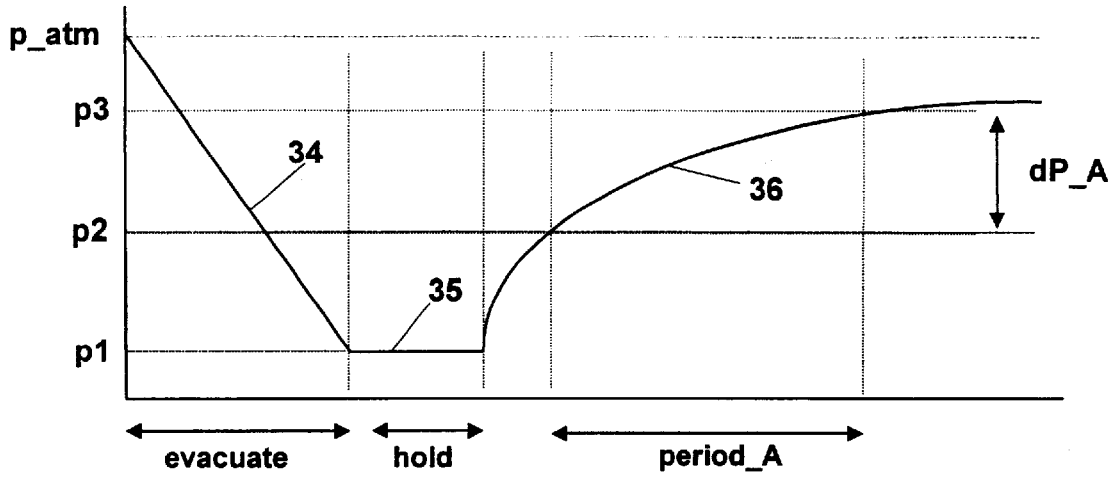
FIG. 3 is a graph of the pressure changes which take place in a first stage of the leak test carried out in the system shown in FIG. 1.

The diagnostic leak testing procedure takes place in two stages. In stage A the pressure changes in the tank 13 as measured by the pressure sensor 15 are illustrated in FIG. 3. During an evacuation phase 34 the ECU closes the CVV 18 and opens the VMV 16 so that air and vapor are pumped out of the tank 13 and canister 20 by manifold vacuum until a desired pressure p1 is achieved. The evacuation phase is followed by a holding stage 35 of several seconds to allow conditions in the tank to approach a steady state and reduce variability due to the speed of evacuation (which is influenced by the level of manifold vacuum, in turn influenced by engine load and throttle position). After the holding phase, the ECU closes both the VMV 16 and the CVV 18, sealing the system. The tank pressure as indicated by the pressure sensor 15 is monitored by the ECU during a bleedup phase 36. At the point in time that the tank pressure recovers to p2, the ECU starts counting out period_A, monitors the pressure p3 at the end of period_A and calculates and saves the pressure difference dP_A=p3−p2.

Figure 4:
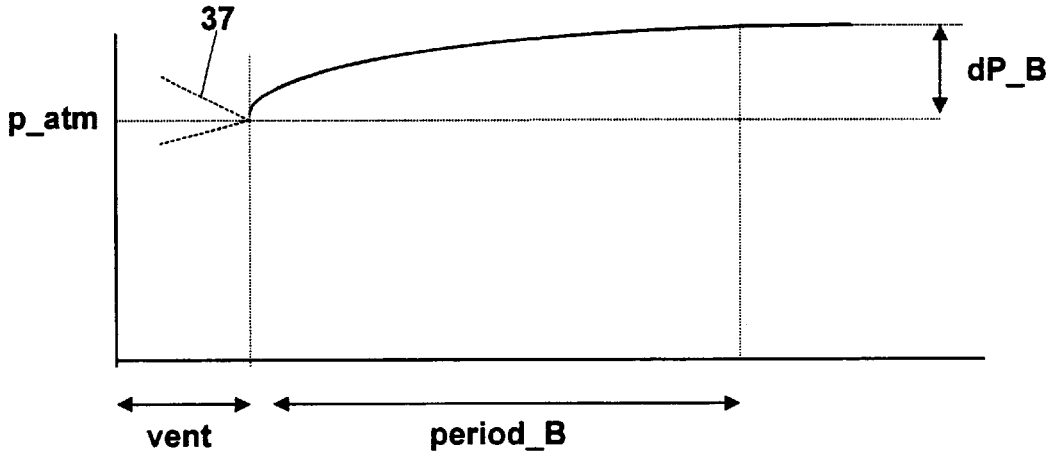
FIG. 4 is a graph of the pressure changes which take place in a second stage of the leak test carried out in the system shown in FIG. 1.

In stage B, which may take place before or after stage A, the pressure changes in the tank 13 are as illustrated in FIG. 4. After initial venting 37 to allow the pressure to go to atmospheric, the ECU closes both the CVw 18 and the VMV 16 and starts period_B. During period_B, the pressure will normally rise due to vapor generation, but may fall under certain conditions, for example if ambient conditions are such that vapor condenses in the tank. At end period_B the ECU monitors the tank pressure p4 and calculates and saves the pressure increase above atmospheric dP_B=p4−p_atm.

The ECU checks ambient temperature and fuel level and looks up the scaling factor K in a table (see FIG. 2) stored in the ECU. Thus, K is mapped against ambient temperature and fuel level/vapor volume.

The ECU calculates a leakage indicating variable X .using the relationship:

$$X=dP_A-K*dP_B$$

The ECU compares X to a threshold level R, which may be a fixed value or may be mapped against fuel level or other information available to the ECU. If X is above the threshold R a leak warning is generated by the ECU.

The values for K in the table of FIG. 4 are determined empirically by carrying out the two stage test described on a fuel systems with a leak of about the size to be detected at various operating conditions.

K may be mapped against ambient pressure, engine speed or_engine load or any combination of these measured variables with fuel level and ambient temperature.

It is to be understood that the embodiment of the invention described above is merely illustrative on one application of the principles of the invention. Numerous modifications may be made to the methods and apparatus described without departing from the true spirit and scope of the invention.

What is claimed is:

1. A vehicle fuel system with on-board diagnostics for leak testing comprising:

a) fuel tank for containing fuel for delivery to an internal combustion engine;

b) a purge canister connected to the space in the tank above the fuel;

c) a canister vent valve (CVV) for connecting the purge canister to the atmosphere;

d) a purge valve for connecting the purge coanister to the engine; and e) an electronic control unit (ECU) arranged for monitoring pressure and fuel level in the tank and other engine, vehicle and ambient conditions and for controlling opening and closing of the valves;

f) the CVV and the purge valve being controlled by the ECU for venting the tank to atmosphere via the purge canister (purge valve closed, CVV open), and for purging vapor from the canister by allowing air to be drawn through the canister by manifold vacuum (both valves open);

g) the ECU being arranged to carry out a periodic two stage leak test, when the engine is running;

h) one stage of the leak test comprising:

i) evacuation of the tank with purge valve open and the CVV closed;

ii) monitoring pressure rise in the tank with both valves closed; and iii) recording the pressure rise dP_A over a predetermined period A following increase of pressure to a predetermined value p2;

i) the other state of the leak test comprising:

i) venting the tank to atmospheric pressure via the CVV then sealing the tank by closing the CVV; and ii) measuring the amount dP_B by which the pressure in the tank rises above atmospheric due to vapour generation over a period (period_B) following closure of the CVV; and h) the ECU being arranged to calculate a value X representative of leakage from the difference between dP_A and dP_B using a scaling factor K wherein K represents a stored value in a two dimensional map indexed by measured values of fuel level and ambient temperature.

2. A vehicle fuel system as claimed in claim 1 wherein K represents a stored value in a two-dimensional map indexed by any two of the following variables: fuel level, air temperature, ambient pressure, engine speed, and manifold depression.

3. A method for performing a two-stage leak test for a vehicle having an engine controlled by an electronic control unit, a fuel system including a fuel tank, a purge canister, a canister vent valve (CVV), and a purge valve, the test comprising:

determining the engine is running;

evacuating the tank with the purge valve open and the CVV closed;

monitoring a pressure rise in the tank with both the valves closed;

recording a pressure rise dP_A over a predetermined period "A" upon determination of a pressure rise to, a predetermined value p2; and thereafter venting the tank to atmospheric pressure via the CVV then sealing the tank by closing the CVV; and measuring the amount dP_B by which the pressure in the tank rises above atmospheric due to vapour generation over a period (period_B) following closure of the CVV; calculating a value X representative of leakage from the difference between dP_A and dP_B ; and modifying X by a scaling factor K representing a stored value in a two-dimensional map indexed by measured values of fuel level and ambient temperature.

4. A method as claimed in claim 3, wherein the value for K represents a stored value in a two-dimensional map indexed by any two of the following variables: fuel level, air temperature, ambient pressure, engine speed, and manifold depression.

* * * * *